US005174891A

United States Patent [19]

Becraft

[11] Patent Number: 5,174,891

[45] Date of Patent: Dec. 29, 1992

[54] METHOD FOR PRODUCING ISOTROPIC COKE

[75] Inventor: Lloyd G. Becraft, Ponca City, Okla.

[73] Assignee: Conoco Inc., Ponca City, Okla.

[21] Appl. No.: 785,444

[22] Filed: Oct. 29, 1991

[51] Int. Cl.[5] ..... C10G 9/14

[52] U.S. Cl. ..... 208/131; 208/50; 208/125; 208/126; 423/445

[58] Field of Search ..... 208/131, 125, 126, 50; 423/449

[56] References Cited

U.S. PATENT DOCUMENTS

| | | | |
|---|---|---|---|
| 2,717,865 | 9/1955 | Kimberlin et al. | 196/56 |
| 3,116,231 | 12/1963 | Adee | 208/46 |
| 3,257,309 | 6/1966 | Fauchier | 208/46 |
| 3,673,080 | 6/1972 | Schlinger et al. | 208/131 |
| 3,704,224 | 11/1972 | Scovill et al. | 208/131 |
| 4,066,532 | 1/1978 | Garcia | 208/131 |
| 4,082,650 | 4/1978 | Li | 208/131 |
| 4,096,097 | 6/1978 | Yan | 208/131 |
| 4,104,150 | 8/1978 | Romey | 208/131 |
| 4,259,178 | 3/1981 | Wynne, Jr. | 208/131 |
| 4,292,165 | 9/1981 | Sooter | 208/131 |
| 4,302,324 | 11/1981 | Chen et al. | 208/131 |
| 4,312,745 | 1/1982 | Hsu et al. | 208/131 |
| 4,427,532 | 1/1984 | Varghese . | |
| 4,713,168 | 12/1987 | Newman . | |
| 4,959,139 | 10/1990 | Blakeburn et al. | 208/39 |
| 5,071,515 | 12/1991 | Newman et al. . | |

*Primary Examiner*—Helane Myers

[57] ABSTRACT

A nonair-blown low sulfur petroleum residual oil is combined with super finely divided particles of calcined premium coke, and the combination is subjected to delayed coking to produce isotropic coke containing reduced sulfur and having a low CTE ratio.

16 Claims, 1 Drawing Sheet

METHOD FOR PRODUCING ISOTROPIC COKE

BACKGROUND OF THE INVENTION

Isotropic coke has a thermal expansion approximately equal along the three major crystalline axes. This thermal expansion is normally expressed as CTE (i.e., coefficient of thermal expansion) over a given temperature range such as 30°-530° C. or 30°-100° C. Isotropic coke is also indicated by a CTE ratio, which is the ratio of radial CTE divided by axial CTE measured on a graphitized extruded rod. Acceptable isotropic coke has a CTE ratio of less than about 1.5 or a CTE ratio in the range of about 1.0-1.5.

Isotropic coke is used to produce hexagonal graphite logs which serve as moderators in high temperature gascooled nuclear reactors. This type of coke has been produced in the past from natural products such as gilsonite. The production of such graphite logs from gilsonite and the use thereof are described in U.S. Pat. Nos. such as 3,231,521 to Sturges, 3,245,880 to Martin et al., and 3,321,375 to Martin et al. U.S. Pat. No. 3,112,181 to Peterson et al., describes the production of isotropic coke using petroleum distillates. Contaminants, such as boron, vanadium, and sulfur, have prohibited the use of some materials as the source of isotropic coke suitable for use in nuclear reactors. Less than about 1.6 weight percent sulfur is preferred to avoid puffing problems upon graphitization and fabrication of the coke. The supply of isotropic coke has been limited by availability of source materials, such as gilsonite and expensive petroleum distillates.

U.S. Pat. No. 3,960,704 describes a process in which a low sulfur residuum, such as bottoms from the fractionation of virgin feedstocks, is air-blown to increase its softening point. The air-blown resid is then subjected to delayed coking to produce isotropic coke having a CTE ratio less than 1.5.

It would be desirable to provide a process for the conversion of low sulfur residual oils to isotropic coke without first air-blowing the residual oils.

Prior Art

U.S. Pat. No. 2,717,865 to Kimberlin Jr. et al., discloses a delayed coking process for coking heavy residual oils, particularly residues from atmospheric or vacuum crude distillation. The process is directed to reducing delayed coker reactor fouling due to coke deposition on reactor walls by diluting the residual oil feedstock with a light distillate in the naphtha boiling range and carrying out the coking reaction in the presence of added subdivided seed solids. The process also includes maintaining the contents of the delayed coker in a state of high turbulence during the coking reaction by mechanical mixing, tangential injection of the feed into the reactor, or by other means. The particle size of the coke solids disclosed in the reference may vary within wide ranges from about 50 to about 250 microns, the smaller sizes such as 5 to 50 microns being generally preferred.

U.S. Pat. No. 3,116,231 describes a delayed coking process using liquid hydrocarbon residuum feedstock to a delayed coking unit. Coke fines in wet or dry state are added to the heated feedstock as it enters the delayed coke drums.

U.S. Pat. No. 3,257,309 discloses a process for manufacturing petroleum coke wherein the coke fines produced during the manufacture of coke are circulated to the delayed coking drums for admixture with petroleum residuum.

U.S. Pat. No. 4,082,650 discloses a process for improving the yield and coke quality of a delayed coker by adding coke fines to a coke drum prior to the introduction of the coke feedstock to the coking drum.

U.S. Pat. No. 4,104,150 discloses a process for producing coke from a pitch wherein the melted pitch is mixed with kieselguhr and filtered. The pitch filtrate is mixed with finely divided petroleum coke to obtain a coke.

U.S. Pat. No. 4,959,139 to Blakeburn et al., discloses the preparation of a binder pitch by combining a petroleum aromatic mineral oil thermal tar with super finely divided calcined premium coke particles. In this reference, the calcined coke super fine particles have an average micron size between about 1 and about 40 microns, preferably between about 1 and about 8 microns and more preferably not more than about 5 microns. The patent further states that calcined coke particles having an average size of 5 microns will usually range in size from less than 1 to about 20 microns with the majority of the particles being in the range of between about 3 and about 12 microns. Binder pitch is used in preparing electrodes from premium coke.

THE INVENTION

In accordance with this invention, a non air-blown low sulfur mineral oil is combined with super finely divided particles of calcined premium coke and the combined material is subjected to delayed coking to provide an isotropic coke product having a low CTE ratio and reduced sulfur content.

DETAILED DESCRIPTION OF THE INVENTION

Figure 1:
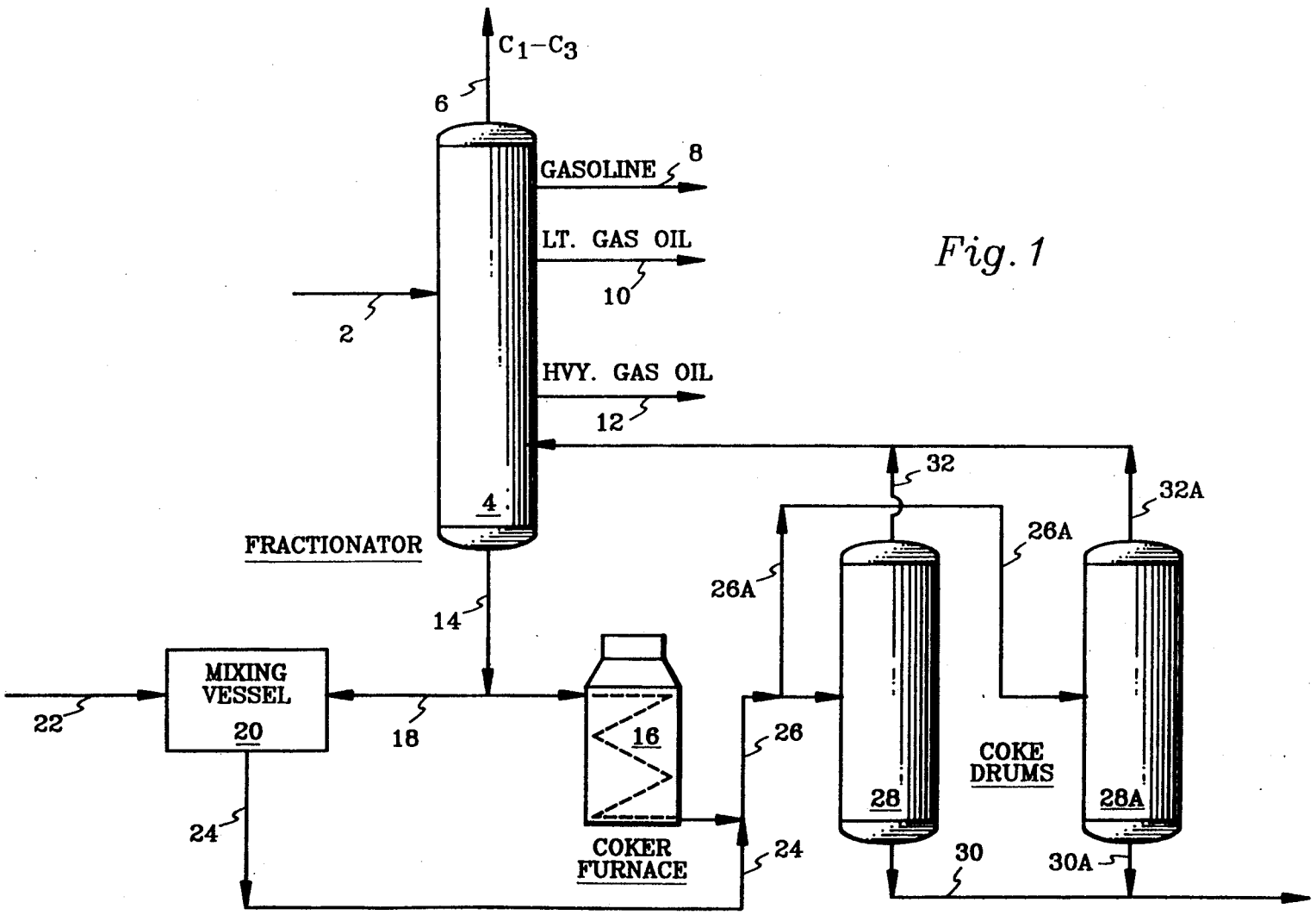
FIG. 1 is a schematic diagram of a process unit which illustrates the process of the invention.

The calcined coke super fines used in the process of the invention may be obtained from any available source of calcined premium coke by subjecting the coke to grinding to provide the desired particle size material. A convenient source of premium coke is the premium coke dust obtained as a by-product of the coke calcining process. The gas discharged from a kiln incidental to the calcination of premium coke includes substantial quantities of dust constituted of fine coke particles. These particles are believed to be produced by wear and breakage of large coke bodies in the kiln feed incidental to handling and tumbling of the feed inside the kiln. The rapid heating of the coke in the kiln may also contribute to particle formation. In any event, the amount of coke discharged from the kiln as fines or dust entrained in the kiln exhaust gases is as much as 5 to 10 percent by weight of the total amount of coke fed to the kiln. Commonly, the kiln flue gases containing the coke dust are passed through a dust collector or other separator which removes the kiln dust from the gas. Consequently, substantial quantities of this kiln dust accumulate incident to the large scale calcination of petroleum coke.

Since kiln dust represents a substantial fraction of the coke feed to a calciner, it is advantageous to utilize this material as a source of the super fines used in the process of the invention. Although the kiln dust is a very fine material, it is still much too large in size to be used in the process of the invention. A typical calcined coke dust has the following approximate composition.

| Particle Size (Tyler Mesh) | Wt % | Micron Equivalence |
|---|---|---|
| Through 100 Mesh | 60–80 | 150 |
| Through 200 Mesh | 20–40 | 75 |
| Through 325 Mesh | 5–25 | 45 |

As can be seen from the table, 60–80 percent of the dust is of a size of 75 microns or larger. The calcined coke super fine particles used in the process of the invention have an average micron size of between about 1 and about 40 microns, preferably between about 1 and about 12 microns, and more preferably not more than about 7 microns. Calcined coke particles having an average size of 7 microns will usually range in size from less than 1 to about 30 microns with the majority of the particles being in the range of between about 3 and about 12 microns. The above values are based on measurements made with a Malvern Particle Sizer 3600 E-type.

The feedstocks used in carrying out the process of the invention are low sulfur heavy aromatic mineral oil fractions which have not been air-blown. These feedstocks can be obtained from several sources including petroleum, shale oil, tar sands, coal, and the like. Illustrative specific feedstocks include slurry oil, also known as decant oil or clarified oil, which is obtained from fractionating effluent from the catalytic cracking of gas oil and/or residual oils. This material usually has an API gravity ranging from about −5 to about +15 degrees and may have a boiling range of 500° to 900° F. or higher. Another feedstock which may be employed is ethylene or pyrolysis tar. This is a heavy aromatic mineral oil which is derived from the high temperature thermal cracking of mineral oils to produce olefins such as ethylene. Pyrolysis tar will have an API gravity varying from about −10 to about +5 and usually has a boiling range of about 600° to about 1200° F. Another feedstock is vacuum resid which is a heavy residual oil obtained from flashing or distilling atmospheric resid, very heavy gas oil, or similar material under a vacuum. Vacuum resid usually has a gravity ranging from about 0 to about 15 and boils above about 900° F. Still another feedstock is vacuum gas oil, which is a lighter material obtained by flashing or distillation under vacuum. This material usually has a gravity from about 10 to about 30 and a boiling range of about 800° F. to about 1100° F. Thermal tar may also be used as a feedstock. This is a heavy oil which is obtained from fractionation of material produced by thermal cracking of gas oil or similar materials. Thermal tar may have an API gravity from about 8 to about −8° and a boiling range of about 550° to about 850° F. (80 percent) Still another feedstock is heavy premium coker gas oil which is the heavy oil obtained from liquid products produced in the coking of oils to premium coke. Heavy premium coker gas oil may have an API gravity from about −7 to about 4 and a boiling range from about 500° to about 925° F. (95 percent). Gas oil from coking operations other than premium coking may also be employed as feedstocks. These other coker gas oils usually have a gravity within the range of about 10 to about 30 and boil between about 600° to about 900° F. Virgin atmospheric gas oil may also be used as a feedstock. This is gas oil produced from the fractionation of crude oil under atmospheric pressure or above. This gas oil may have an API gravity varying from about 20 to about 40 and a boiling range from about 600° to about 850° F. Any of the preceding feedstocks may be used singly or in combination.

As pointed out previously, acceptable isotropic coke preferably contains less than about 1.6 weight percent sulfur. With some aromatic mineral oil feedstocks, the sulfur contained in the feedstock is concentrated in the coke product. Thus, the isotropic coke product will contain more sulfur than the starting mineral oil feedstock. This is particularly true when utilizing virgin feedstocks such as virgin residual oil. When using this type of feedstock, the mineral oils processed in accordance with the invention are selected from those containing less than about 1.6 weight percent sulfur and preferably not more than about 1.0 weight percent sulfur.

Conversely, in the feedstocks which have been thermally or catalytically processed, such as decant oil and pyrolysis tar, the sulfur content of the feedstock may be higher, since with these materials, sulfur is not concentrated in the coke product. The coke product may even contain a lower level of sulfur than the starting mineral oil feedstock. When using such materials, the sulfur content of the feedstock may be up to 1.6 weight percent or even higher, depending on the particular feedstock.

The feedstocks used in carrying out the coking process of the invention usually contain between about 1 and about 20 weight percent of super fine calcined coke particles and preferably between about 3 and about 10 weight percent of such particles.

The feedstocks described for use in the process are those which do not alone produce acceptable isotropic coke when subjected to delayed coking. As pointed out previously, acceptable isotropic coke has a coefficient of thermal expansion ratio (CTE ratio) of less than about 1.5. The mineral oil feedstocks usually produce an isotropic coke product which has a CTE ratio of 2.0 or higher.

The mixture of super finely divided particles of calcined premium coke and nonair-blown heavy aromatic mineral oil is converted to isotropic coke by subjecting it to delayed coking. The manufacture of coke by delayed coking refers to the formation of coke in a coke drum, such as described in U.S. Pat. No. 2,922,755 to Hackley. The delayed coking process typically uses petroleum feedstock, such as residuum or a mixture of various petroleum fractions to produce petroleum coke.

Referring now to FIG. 1, a nonair-blown low sulfur heavy aromatic mineral oil, such as a reduced virgin crude oil, is introduced through line 2 to fractionator 4 where it is combined with overhead vapors from coke drums 28 and 28A. Light gases, $C_1$ to $C_3$ are removed overhead from the fractionator through line 6. Heavier materials, such as gasoline and light gas oil, are taken from the fractionator through lines 8 and 10, respectively. A mixture of reduced crude oil and diluent heavy gas oil is removed from the bottom of fractionator 4 through line 14. The purpose of the diluent gas oil is to reduce the viscosity of the mixture and permit easier handling and pumping of the mixture to the delayed coking part of the process. The diluent heavy gas oil which is part of the gaseous effluent from the coke drums does not substantially coke and therefore recycles through the system. The amount of such diluent provided in the reduced crude oil may be controlled by varying the amount of heavy gas oil withdrawn from fractionator 4 through line 12.

A small portion or slipstream of the mixture of residual oil and heavy gas oil leaving fractionator 4 through line 14 is introduced through line 18 to mixing vessel 20. Here it is joined by calcined coke super fines introduced through line 22. After mixing is completed, the combined residual oil, diluent heavy gas oil and coke super fines is withdrawn from mixing vessel 20 through line 24.

The major portion of the mixture of reduced crude oil and heavy gas oil leaving fractionator 4 is introduced to coker furnace 16 wherein it is heated to temperatures in the range of 875° to 975° F. at pressures of about atmospheric to about 250 psig. The material from mixing vessel 20 containing the calcined coke super fines is combined via line 24 with the heated mixture of reduced crude oil and heavy gas oil leaving coker furnace 16 and the total mixture is then passed via lines 26 or 26A to coke drums 28 or 28A. The coke drums operate on alternate coking and decoking cycles of from about 8 to about 100 hours; while one drum is being filled with coke, the other drum is being decoked. During the coking cycle, each drum operates at a temperature between about 830° and 950° F. and a pressure from about 15 to about 200 psig.

The overhead vapor from the coke drums is passed via lines 32 or 32A to fractionator 4, wherein it is separated into various fractions as previously described. The green coke which is removed from the coke drums through outlets 30 and 30A is further processed (not shown) to produce hexagonal graphite logs which are used as moderators in high temperature, gas-cooled nuclear reactors. The manufacture of such rods involves a series of steps which include calcination, heating to remove volatile hydrocarbons, graphitization, and densifying treatment These steps, which do not perform a part of the invention, are described in detail in U.S. Pat. No. 3,112,181 to Peterson et al., which patent is incorporated herein by reference.

As shown in the drawing, the reduced crude oil is fed into a fractionator from which a combined mixture of reduced crude oil and heavy gas oil is withdrawn as feed to the delayed coker. This type of operation is typical of a commercial unit. However, reduced crude oil can be fed directly to a furnace and thereafter introduced to the coke drums. In the latter operation, the diluent, if used, can be heavy gas oil obtained from the coking operation or another suitable diluent material.

The isotropic coke produced by the process of the invention has excellent quality, as indicated by a low CTE ratio, usually less than about 1.5, and by low sulfur content, usually not more than about 1.6 percent. The CTE of the coke product can be measured by an of several standard methods. For the isotropic coke of this invention, the coke is crushed and pulverized, dried, and calcined to about 2,400° F. This calcined coke is sized so that about 50 percent passes through a No. 200 U.S. standard sieve. The calcined coke is blended with coal tar pitch binder and a small amount of lubricant. The mixture is extruded at about 1,500 psi into electrodes of about three-fourths-inch diameter and about 5 inches long. These electrodes are heated slowly up to a temperature of about 850° C. and heat-soaked for two hours. After a slow cool-down period (8–10 hours), the baked electrodes are graphitized at approximately 3,000° C. Test pieces are machined from the graphitized electrodes. The coefficient of thermal expansion of the test specimens is then measured in the axial and radial directions over the range of about 30°–130° C. heated at a rate of about 2° C. per minute. The CTE ratio, as used herein, is the ratio of the radial CTE to axial CTE of the graphitized electrodes.

When subjected to coking, the low sulfur heavy aromatic mineral oils used in the process of the invention do not produce an isotropic coke product, yet the combination of these mineral oils with super finely divided particles of calcined premium coke when coked together yields an isotropic coke product having a low CTE ratio.

The following example illustrates the results obtained in carrying out the invention:

EXAMPLE

Batch coking experiments were carried out at 840° F. and 60 psig for a period of 8 hours. Two low sulfur residual oil feeds were used in the experiments. The composition of the feedstocks is shown in Table 1.

TABLE 1

PROPERTIES OF LOW SULFUR RESID FEEDSTOCKS

| Vacuum Residual Oil Properties | No. 1 | No. 2 |
|---|---|---|
| API Gravity | 17.0 | 15.8 |
| Density, g/cc | 0.953 | 0.960 |
| Sulfur, wt % | 0.73 | 0.82 |
| Nitrogen, wt % | 0.36 | 0.38 |
| Oxygen, wt % | 0.45 | 0.50 |
| Carbon Residue, wt % | 8.5 | 10.4 |
| Asphaltenes, wt % | 1.5 | 0.5 |
| COC Flash, F | 620 | 590 |
| Viscosity, CST | | |
| @120° C. | 45.5 | 66.7 |
| @135° C. | 29.6 | 37.5 |
| @150° C. | 17.8 | 23.9 |
| Metals, ppm | | |
| B | — | <0.25 |
| V | 15 | 18 |
| Ni | 12 | 11 |
| Fe | 77 | 69 |
| Cu | <2 | <2 |
| Ti | <2 | <5 |
| Zn | 1 | <2 |
| Ca | <4 | <15 |
| Mn | <2 | <5 |
| ASTM Dist., F @ 760 mm Hg | | |
| 5 vol % | — | 936 |
| 10 vol % | — | 973 |

Runs were carried out in which one of the residual oil feedstocks was combined with super finely divided particles of calcined premium coke. For comparison, additional runs were made in which the other residual oil was combined with calcined premium coke fines from a commercial coking operation. The properties of the two coke fines used in the experiments are contained in Table 2.

TABLE 2

PROPERTIES OF CALCINED PREMIUM COKE FINES

| Description Properties | As-Received Fines | Super Finely Divided Particles |
|---|---|---|
| Ash, wt % | 0.34 | 0.18 |
| Sulfur, wt % | 0.36 | 0.31 |
| Nitrogen, wt % | 0.22 | — |
| Carbon, wt % | 99.4 | — |
| Hydrogen, wt % | 0.03 | — |

TABLE 2-continued

PROPERTIES OF CALCINED PREMIUM COKE FINES

| Description Properties | As-Received Fines | Super Finely Divided Particles |
|---|---|---|
| Density, g/cc | | |
| Real (Kero., −200 mesh) | 2.110 | — |
| Bulk (As Received) | 0.86 | 0.34 |
| Metals, ppm | | |
| Al | 220 | 180 |
| Ca | 66 | 110 |
| Fe | 220 | 200 |
| Mn | 6 | <5 |
| Ni | 9 | <5 |
| Si | 260 | 408 |
| Na | 88 | 70 |
| Ti | 9 | 9 |
| V | 6 | <5 |
| Zn | 5 | 22 |
| Cu | <5 | 5 |
| Mg | 500 | 73 |
| Particle Sizing | wt % | vol % |
| >1000 microns | 0 | 0 |
| 425-1000 | 2.8 | 0 |
| 150-425 | 39.3 | 0 |
| 75-150 | 33.1 | 0 |
| 53-75 | 8.2 | 0 |
| 38-53 | 5.4 | 0 |
| <38 | 11.2 | 100 |
| 11-28 | — | 10 |
| 5.4-11 | — | 40 |
| 2.6-5.4 | — | 40 |
| <2.6 | — | 10 |

It is noted from Table 2 that the super finely divided particles of calcined premium coke consisted of particles of which 90 percent had nominal diameters of 11 microns or less. By comparison, the commercial premium coke fines were made up of a mixture in which almost 90 percent of the fines had a size range from 38 microns to greater than 1,000 microns.

The results of the experiments are set forth in Table 3.

TABLE 3

COKE YIELDS AND PROPERTIES

| Run No. | 1 | 2 | 3 | 4 | 5 | 6 | 7 | 8 | 9 |
|---|---|---|---|---|---|---|---|---|---|
| Feedstock Composition, wt % | | | | | | | | | |
| Residual No. 1 | 100 | 0 | 99 | 98 | 95 | 92 | — | — | — |
| Residual No. 2 | 0 | 100 | — | — | — | — | 96 | 92 | 88 |
| Calcined Coke Super Fines | 0 | 0 | 1 | 2 | 5 | 8 | — | — | — |
| Commercial Calcined Coke Fines | 0 | 0 | — | — | — | — | 4 | 8 | 12 |
| Coke Yield, wt % | 18.2 | 19.9 | 19.3 | 19.9 | 22.4 | 25.0 | 23.0 | 26.0 | 29.5 |
| Portion of Product Coke from Fines, wt % | 0 | 0 | 5.2 | 10.0 | 22.4 | 32.0 | 17.4 | 30.8 | 40.6 |
| Coke Properties | | | | | | | | | |
| Sulfur (green), wt % | 1.42 | 1.52 | 1.32 | 1.42 | 1.16 | 0.99 | 1.30 | 1.12 | 1.11 |
| Sulfur (calcined), wt % | 1.26 | 1.47 | — | — | — | — | 1.23 | 1.06 | 1.00 |
| Transverse/Axial CTE Ratio | 3.3 | 3.5 | 2.4 | 2.2 | 1.5 | 1.4 | 2.3 | 2.8 | 3.1 |

It is noted from the table that the runs in which the residual oil contained coke super fines produced a coke product having a CTE ratio substantially lower than that of the coke products obtained by coking the residual oil alone. Increased amounts of the coke super fines produced increasingly lower CTE ratios and, in the case of Runs 5 and 6, ratios at or below 1.5. The runs in which the residual oil contained commercial calcined coke fines also produced coke having lower CTE ratios than the ratios obtained in the coke product from the residual oils alone. However, in this instance, the CTE ratios of the coke were substantially above those required for good isotropic coke. It is further noted that as increased amounts of the commercial calcined coked fines were used the values of CTE ratio for the coke products obtained also increased.

The calcined coke super fines which are combined with the residual oils when carrying out the process of the invention usually have a low sulfur content which may vary from about 0.3 to 1.0 weight percent. As a result, the cokes prepared from the combination feedstocks frequently have a lower sulfur content than the starting residual oils. Depending on the amount of calcined coke super fines added to the residual oil, such residual oils may have a sulfur content up to as high as 2 weight percent and still provide a suitable isotropic coke product having a sulfur content not more than about 1.6 weight percent.

In the process of the invention described in conjunction with FIG. 1, the calcined coke super fines are combined with the residual oil feed downstream of the coker furnace and prior to introduction of the residual oil feed to the coke drums. It is also within the scope of the invention to introduce the coke super fines directly into the coke drums, or as another alternative, the super fine coke particles may be combined with the residual oil feedstock prior to the introduction of such feedstock to the coker furnace.

Any suitable commercially available grinding equipment may be used to obtain the calcined coke super fine particles, whether such particles are provided from calcined coke dust or from other sources of calcined premium coke.

While certain embodiments and details have been shown for the purpose of illustrating the present invention, it will be apparent to those skilled in the art that various changes and modifications may be made herein without departing from the spirit and/or scope of the invention.

I claim:

1. In a process in which a hydrocarbon feedstock consisting essentially of a nonair-blown sulfur-containing heavy aromatic mineral oil which does not produce acceptable isotropic coke when subjected to delayed coking is subjected to delayed coking to produce isotropic coke, the improvement which comprises combining the heavy aromatic mineral oil with super finely divided particles of calcined premium coke having an average diameter between about 1 and about 40 microns prior to carrying out the delayed coking.

2. The process of claim 1 in which the calcined premium coke particles have an average diameter of not more than about 7 microns.

3. The process of claim 2 in which the heavy aromatic mineral oil is a reduced virgin crude oil.

4. The process of claim 3 in which the calcined premium coke particles constitute between about 1 and about 20 weight percent of the combination of residual oil and coke particles.

5. The process of claim 4 in which the calcined premium coke particles are obtained by grinding calcined coke dust formed during calcination of coke.

6. The process of claim 1 in which the delayed coking is carried out at a temperature of between about 830° F. and about 950° F., a pressure of between about 15 psig and about 200 psig for about 8 hours to about 100 hours.

7. A for producing isotropic coke having a low CTE ratio from a hydrocarbon feedstock consisting essentially of a nonair-blown sulfur-containing heavy aromatic mineral oil, which when subjected to delayed coking produces a coke having a coefficient of thermal expansion ratio of 2.0 or higher, which comprises:

(a) Combining the heavy aromatic mineral oil with super finely divided particles of calcined premium coke, having an average diameter of between about 1 and about 40 microns, and (b) Subjecting the combined material to delayed coking to produce isotropic coke having a CTE ratio of less than about 1.5.

8. The process of claim 7 in which the calcined premium coke particles have an average diameter of not more than about 7 microns.

9. The process of claim 8 in which the calcined premium coke particles constitute between about 1 and about 20 weight percent of the combined residual oil and coke particles.

10. The process of claim 9 in which the residual oil is a reduced virgin crude oil.

11. A process for producing isotropic coke having reduced sulfur content and a low CTE ratio which comprises:

(a) combining a hydrocarbon feedstock consisting essentially of a nonair-blown sulfur-containing heavy aromatic mineral oil which when subjected to delayed coking produces a coke having a coefficient of thermal expansion ratio of 2.0 or higher with super finely divided particles of calcined premium coke having an average diameter between about 1 and about 40 microns, and (b) subjecting the combined material to delayed coking to produce an isotropic coke having a CTE ratio of less than about 1.5 and reduced sulfur content.

12. The process of claim 6 in which the heavy aromatic mineral oil is a reduced virgin crude oil.

13. The process of claim 12 in which the finely subdivided calcined premium coke particles have an average diameter not more than about 7 microns.

14. The process of claim 13 in which the delayed coking is carried out at a temperature of between about 830° F. and about 950° F., a pressure of between about 15 psig and about 200 psig for about 8 hours to about 100 hours.

15. The process of claim 14 in which the calcined premium coke particles constitute from about 1 to about 20 weight percent of the combination of residual oil and coke particles.

16. The process of claim 15 in which the calcined premium coke particles are obtained by grinding calcined coke dust formed during calcination of coke.

* * * * *